US005195731A

United States Patent [19]

Kobler et al.

[11] Patent Number: 5,195,731

[45] Date of Patent: Mar. 23, 1993

[54] METHOD AND APPARATUS FOR STACKING FOLDED PRODUCTS, ESPECIALLY NEWSPAPERS, HAVING LONGITUDINAL FOLDS AND, POSSIBLY, ALSO CROSS FOLDS

[75] Inventors: Ingo Kobler, Anhausen; Godber Petersen, Augsburg, both of Fed. Rep. of Germany

[73] Assignee: MAN Roland Druckmaschinen AG, Offenbach am Main, Fed. Rep. of Germany

[21] Appl. No.: 518,806

[22] Filed: May 4, 1990

[30] Foreign Application Priority Data

May 10, 1989 [DE] Fed. Rep. of Germany ..... 3915195

[51] Int. Cl.[5] ..... B65H 39/10

[52] U.S. Cl. ..... 270/55; 414/788.3

[58] Field of Search ..... 270/55, 57, 39; 414/786, 788.3, 791.2, 791.3

[56] References Cited

U.S. PATENT DOCUMENTS

| | | | |
|---|---|---|---|
| 3,206,189 | 9/1965 | Heywood | 414/788.3 X |
| 4,015,724 | 4/1977 | Spencer | 414/788.3 |
| 4,530,694 | 7/1985 | Kobler et al. | 198/377 |
| 4,605,213 | 9/1986 | Hechler | 270/55 |
| 4,807,865 | 2/1989 | Kobler et al. | 270/54 |
| 4,840,365 | 6/1989 | Kobler et al. | 270/54 |
| 4,871,159 | 10/1989 | Petersen | 270/55 |
| 5,110,116 | 5/1992 | Kobler et al. | 414/788.3 X |

FOREIGN PATENT DOCUMENTS

| | | |
|---|---|---|
| 0030653 | 6/1981 | European Pat. Off. . |
| 2436662 | 2/1975 | Fed. Rep. of Germany . |
| 1322946 | 2/1963 | France . |

*Primary Examiner*—Michael S. Huppert
*Assistant Examiner*—Janice Krizek
*Attorney, Agent, or Firm*—Frishauf, Holtz, Goodman & Woodward

[57] ABSTRACT

To form a stack of essentially uniform height of folded products, typically newspapers, in which each one of the folded products (1, 2) may include a plurality of sheet elements, such as newspaper sections, the folded products being formed, for example, with a longitudinal fold (3, 4) and a cross fold (5, 6). The products (1, 2) are spread apart by suitable spreaders (26, 27; 46, 47; 64, 65) to hold the sheet portions spread-apart in open V-shaped configuration; holders (24, 25; 46, 47; 48, 48'), having at least two parts, hold sequentially first and second alternate folded products, one of the folded products being rotated 180° with respect to the other, for example by a rotary apparatus (32; 31; 42; 59), the then rotated products being interdigited with the non-rotated products upon being moved towards each other, for example being laterally fed towards each other by a gripper robot, by approaching conveying chain guides, or by being moved vertically against each other, to form a double-comb-like interdigited assembly of the first and second products which, when stacked vertically, will provide a stack of circumferentially essentially uniform height.

16 Claims, 16 Drawing Sheets

METHOD AND APPARATUS FOR STACKING FOLDED PRODUCTS, ESPECIALLY NEWSPAPERS, HAVING LONGITUDINAL FOLDS AND, POSSIBLY, ALSO CROSS FOLDS

FIELD OF THE INVENTION

The present invention relates to a method and apparatus to stack folded products, and more particularly to stack newspapers which may include magazine inserts, so that fold lines arise in the completed products which extend longitudinally and, possibly, also at right angles to the longitudinal fold.

BACKGROUND

Apparatus has previously been described—see U.S. Pat. No. 4,530,694, Kobler, the disclosure of which is incorporated by reference—to rotate sheets or packages of sheets about 90° in the major plane of the sheets. Sheets may have to be rotated when they have been folded. Due to the fold, one edge will be thicker than the other and, upon stacking of folded products, the incremental thickness at the folds may add; when a certain height of a stack is reached, the stack becomes unstable and tends to tip over.

The known apparatus merely permits folded products to rotate by 90° so that, upon alternate stacking of rotated and original, non-rotated products, a stack will be formed with two sides of essentially uniform height. Such a stacking arrangement is substantially better than a stack of folded products in which none of them are rotated; yet, the stability of such a stack is not sufficient after a predetermined height thereof has been reached. Opening of the stacked products is only possible if the stacked products contain an additional fold-in sheet, to separate the individual sheet elements which have been folded.

Apparatus as described to rotate predetermined folded products, for example all the odd folded products within a sequence thereof, is insufficient if the folded products, or packages thereof, have two folds, that is, have a longitudinal fold and a cross fold extending at right angles to the longitudinal fold. If such folded products are supplied to the known apparatus, compensation for height differences would be possible; opening of the folded products, however, at the fold sheets would not be possible without providing an additional fold-in flap on one of the sheet elements. The following patents and application, assigned to the assignee of the present invention, the disclosures of which are hereby incorporated by reference, relate to subject matter of this application:

U.S. Pat. No. 4,840,365, Kobler et al

U.S. Pat. No. 4,807,865, Kobler et al

U.S. Pat. No. 4,871,159, Petersen

U.S. Ser. No. 07/519,119, filed May 4, 1990, Kobler et al, now U.S. Pat. No. 5,110,116.

THE INVENTION

It is an object to provide a method and apparatus which ensures reliable stable stacking of folded products which have identical orientation, and especially folded products which may have not only a longitudinal fold but, in addition thereto, a cross fold, and in which the stack, when reaching a certain height level, will be stable and flat, without danger of tipping; and which, still, permits opening of the sheet elements of the stack without use of a folding or opening flap.

Briefly, the folded products are held spread apart, so that the individual sheet elements, which together form the folded product, are spread apart at a separating plane. The spread apart sheets are introduced, alternately, to a holder structure which has at least two parts, each one of them holding sequentially alternate folded products, which, for ease of description, may be termed even and odd products. A rotary system is provided, coupled to one of the parts to rotate the products thereon by 180° about an axis essentially perpendicular to the major plane of the products. The parts are then moved towards each other, after having been rotated, in such a way that the spread-apart products are interdigited or inserted into each other in a comb-like arrangement-when viewed from an edge of the folded products.

The term "orientation" as used herein refers to the orientation of the product with respect to its fold or back.

The system has the advantage that the folded products although received in identical orientation, will, when stacked above each other, result in a stack which will remain flat and not have a tendency to tip, while permitting ready separation of the products from each other by merely pulling out a product at the fold line from between the two opposite adjacent products which are interdigited therewith. The arrangement has the further advantage that the stacked, comb-like interdigited sheets or packages of sheets can readily be opened again without use of a folding flap, for example in order to place inserts therein. Use of folding flaps, which have to be separated before the products can be sold or given away, not only causes additional separation work, but also wastes papers.

DRAWINGS

DETAILED DESCRIPTION

Figure 4:
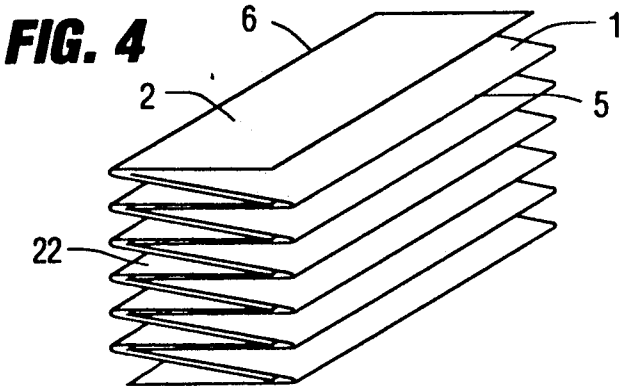

Referring first to FIGS. 1-4:

A folded product, typically a printed product 1, 2 which may be formed of a plurality of individual elements, for example a section or group of sections of a newspaper, is folded at lines 3 and 4 and further, at right angles thereto, at lines 5 and 6, to form respective fold lines 3, 4; 5, 6. The products are essentially flat and each defines a major plane. Usually, the fold lines 3, 4 are termed the "longitudinal fold" and the fold lines 5, 6 the "cross fold". This, then, leaves individual open sides of the products at 7, 8 and 9, 10, as well as at 7', 8', 9', 10'. The folded products 1, 2 have different heights at the corners 11, 12, 13, 14 and 15-18 due to the different formation of the sides, folded at the edges 3, 5 and 4, 6 and open at the edges 7, 7', 8, 8' and 9, 9', 10, 10'. Each one of the portions or sides 1*a*, 1*b*, 2*a*, 2*b* of the folded products may be formed by a multiplicity of individual sheet elements. If these folded products 1, 2, which are identically oriented, are stacked in the alignment shown in FIG. 1, the difference in height between the folded edges 3, 5; 4, 6 and the unfolded edges 7, 7', 8, 8'; 9, 9', 10, 10' will cause the stack to become tippy and unstable when it reaches a certain height. The products 1, 2 of FIGS. 2-4 are respectively oppositely oriented since backs 5, 6 are at opposite sides with respect to the free edges 7, 7' and 9, 9'.

Figure 1:
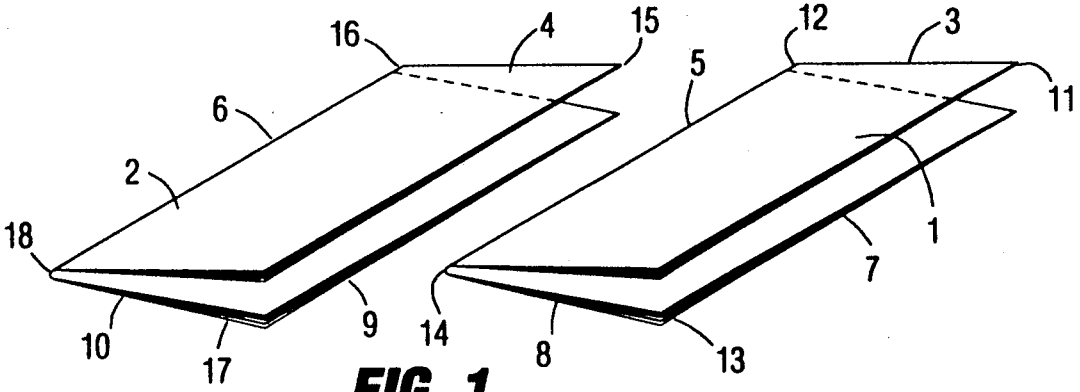
FIGS. 1 to 4 are schematic isometric views of the formation of a stack starting with two folded products.
Figure 2:
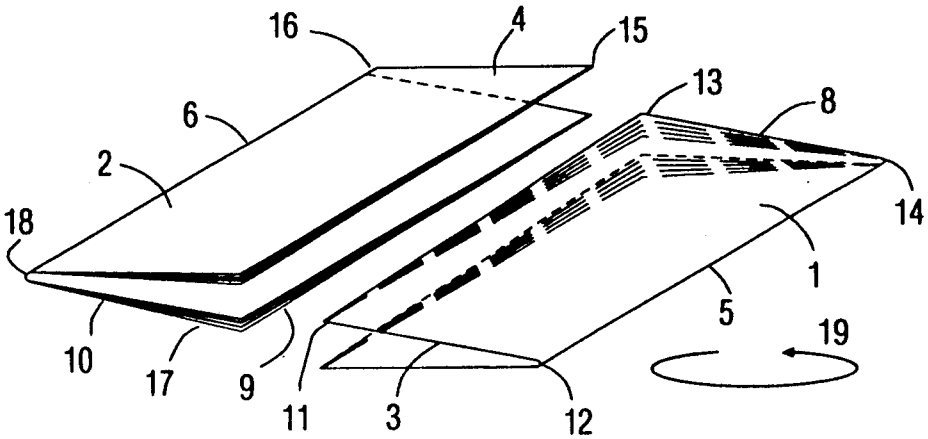
Figure 3:
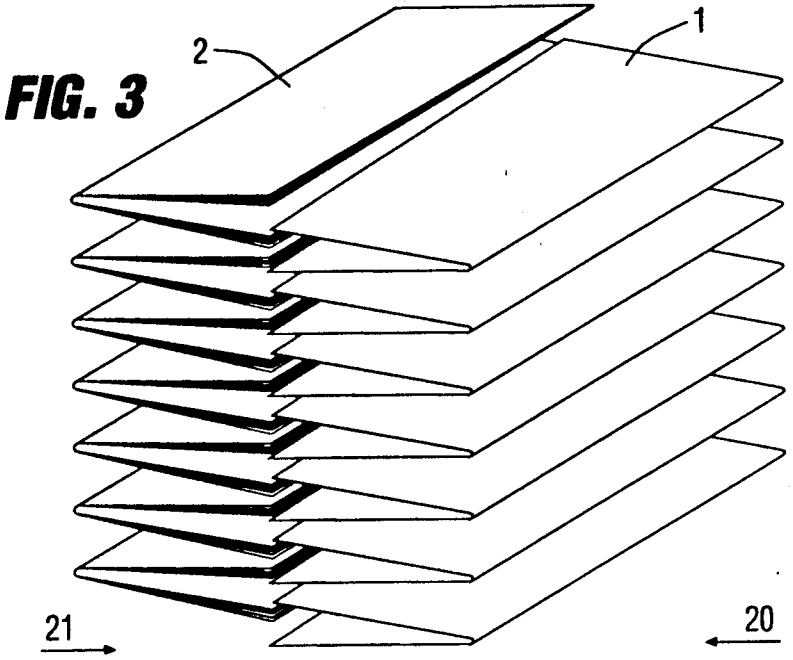

FIG. 2 illustrates that, after rotating product 1 as shown schematically by the arrow 19 about an axis perpendicular to the major plane of the product by 180°, and subsequent matching of the folded edges and open edges above each other, height or thickness differences will be compensated.

Upon rotating, thus, each alternate or second or other folded product in the direction of the arrow 19, the sheets can further be inserted as shown schematically by arrows 20, 21 (FIG. 3) into each other, in zig-zag shape. Thus, the result will be a stable stack 22, as seen in FIG. 4. This stack 22 further permits ready access at a later time to remove sheets from the closed edges 3, 5 or 4, 6, with the result that the folded products 1, 2 will open from the middle on out.

Figure 5:
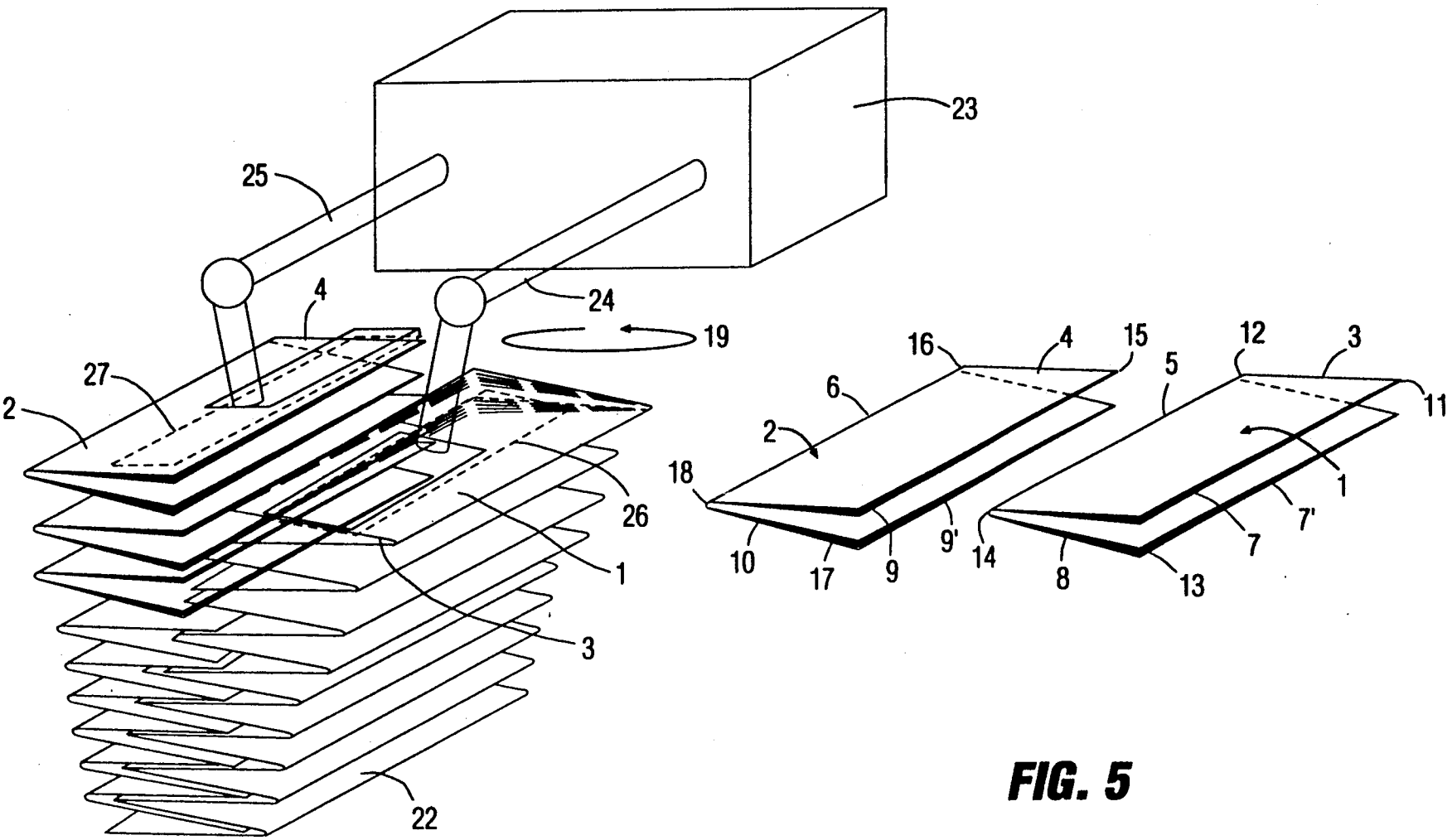
FIG. 5 is a schematic view of a first embodiment of an apparatus to form the stack of FIG. 4.

An apparatus to carry out the rotating and comb-like insertion of the elements is shown in FIG. 5. A gripping and transfer robot 23, for example operating with suction heads, grips the folded products 1, 2 received in identical orientation, by being delivered from a transport belt. The transfer and gripping robot 23 has gripper arms 24, 25 with separating sheets 26, 27 thereon. The separating sheets 26, 27 are slipped between the already spread-apart sheet elements 7, 7' and 9, 9', respectively (see FIG. 1), for example and preferably from the longitudinal fold sides 3, 4. One of the folded products, in the example of FIG. 5 the product 1, is then rotated by rotating the printed product on the separating sheet 26 attached to the gripper arm 24 by 180°. Upon slightly spreading the elements 9, 9' of the folded product 2, the top element 7 of products is placed in the open fold between the elements 9, 9', in zig-zag interdigited position to form the stack 22. The folded products 1, 2 thus are interdigited in a comb-like manner, to form a stable stack which will not tip or slide.

A second embodiment of an apparatus to interdigit folded products so that they will form a stable stack is shown in FIGS. 6-10.

A printing machine, not shown, provides printed products to a folding apparatus 29. The folding apparatus 29 may include a folding flap cylinder 28 or other well known folding structures and, after leaving the folding flap cylinder 28 of the folding apparatus 29, a splitting device 30 separates the printed products into two streams or channels of products, so that products 1 are transported only at a lower level or channel, and products 2 only at an upper level or channel. The products 1, as they travel, are rotated by a rotating and continuous supply apparatus 31 by 180°. The rotating-and-transporting or supply apparatus 31 can be in accordance with a suitable known structure, for example one described in general in the U.S. Pat. No. 4,530,694, with the difference, however, that contrary to the teaching of the earlier U.S. patent, the sheets are rotated by 180° rather than by only 90°.

Figure 6:
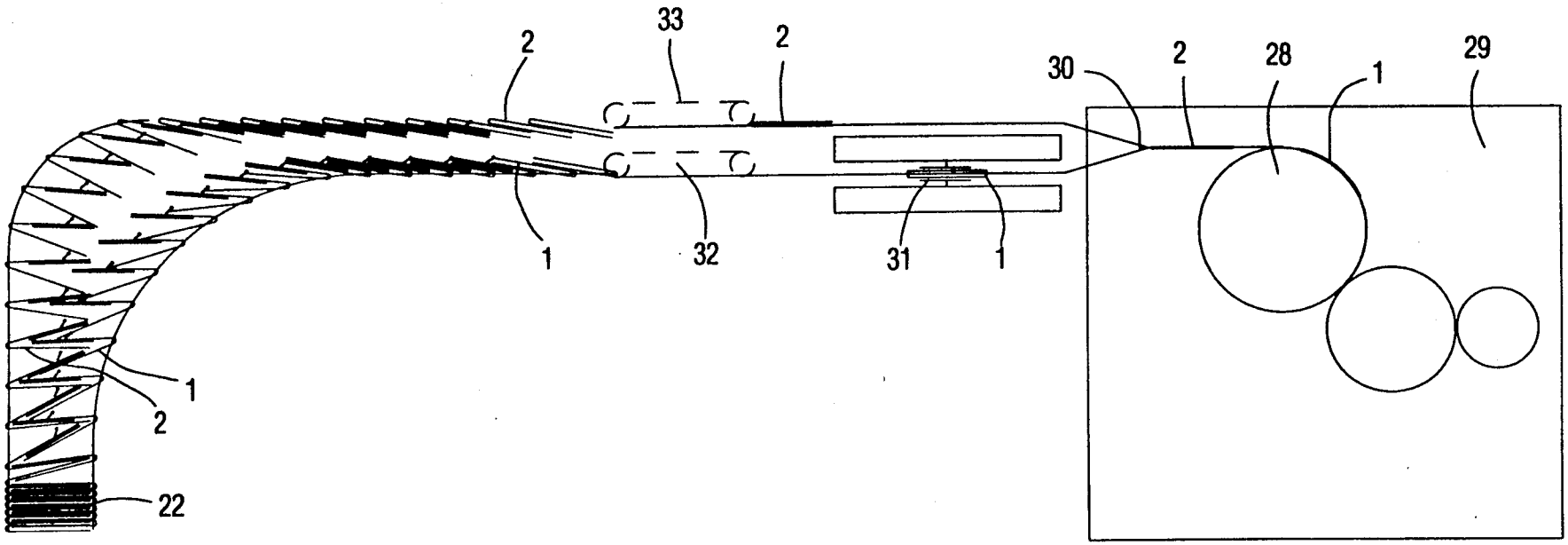
FIG. 6 is a schematic side view of a second embodiment of an apparatus to provide interdigited folded products.

Both of the streams of the sheets 2 and the sheets 1', now rotated by 180°, are transported in customary transport systems 32, 33, for example belt transports, and then braked or retarded to be placed in each one of the streams in imbricated or shingled position, as shown in FIG. 6. FIGS. 7-10 illustrate the further handling of the sheets to an enlarged scale.

Figure 7:
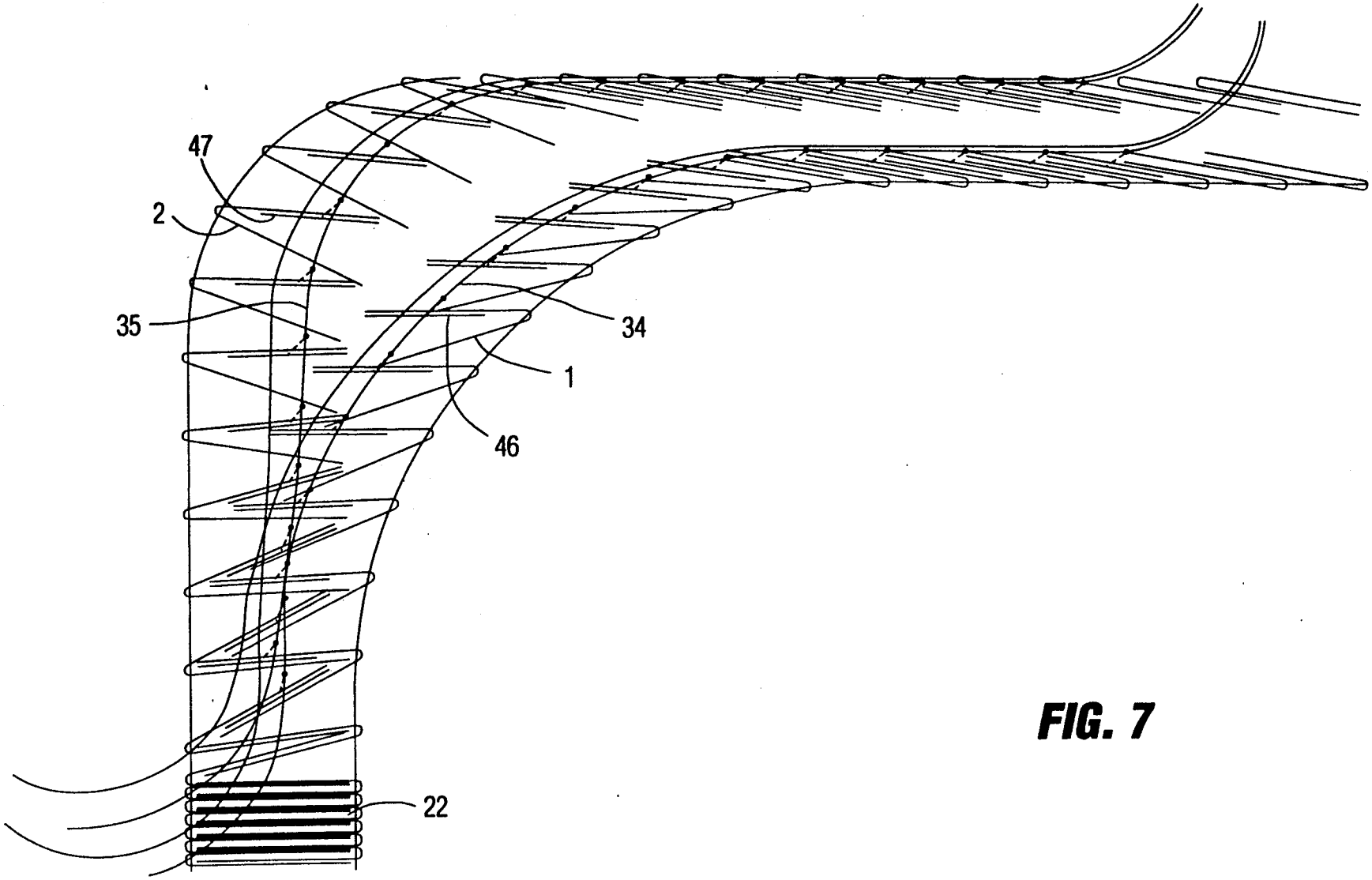
FIG. 7 is a detailed fragmentary view of part of embodiment of FIG. 6 to an enlarged scale.
Figure 8:
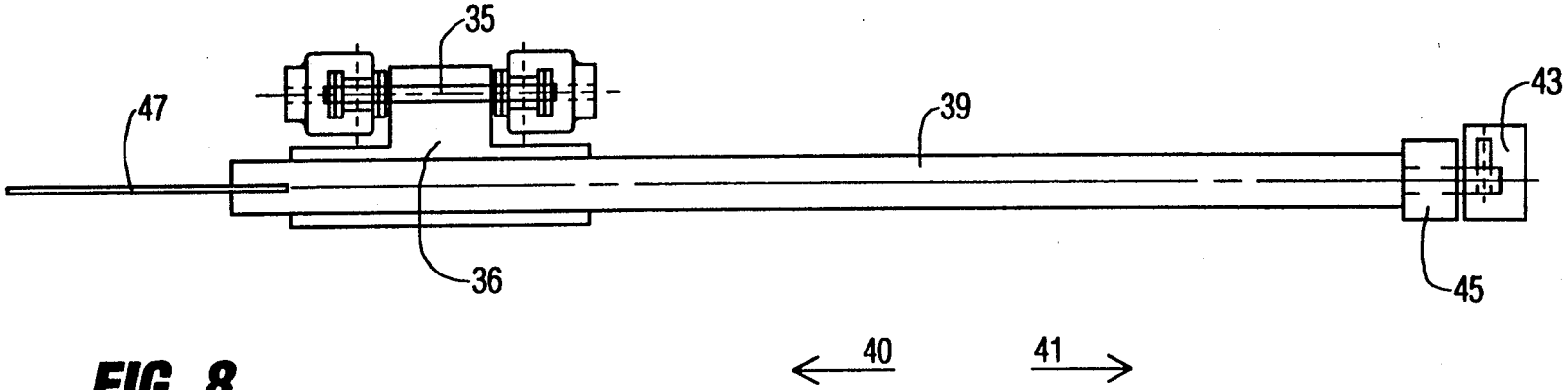
FIG. 8 is a side view of an apparatus used in the system of FIG. 6.
Figure 9:
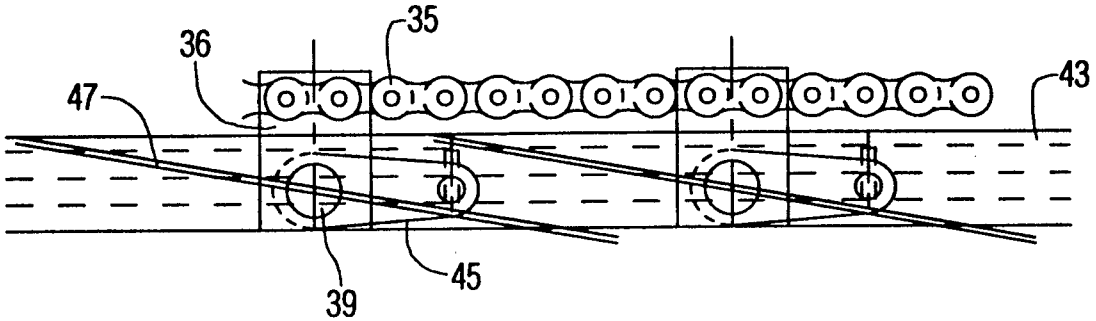
FIG. 9 is a fragmentary view of the apparatus of FIG. 8.
Figure 10:
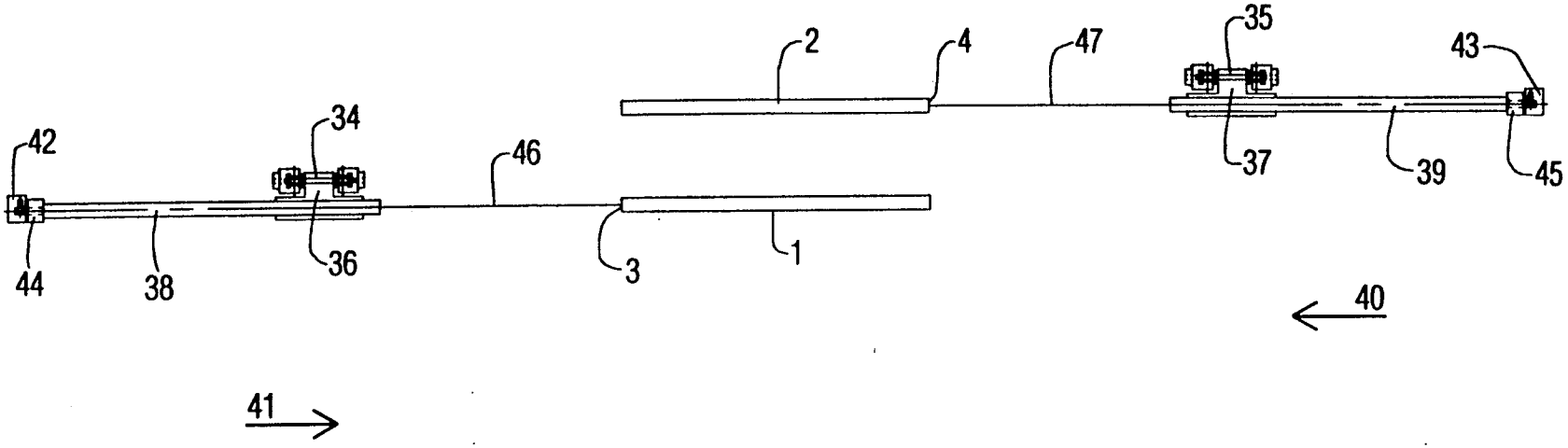
FIG. 10 illustrates the interaction of two insertion elements of FIG. 6.

Transport chains 34, 35 (FIGS. 7, 9, 10) are located at the sides of the streams of printed products. The chains 34, 35 include guide elements 36, 37 thereon in which rods 38, 39 can move in the direction of the arrows 40, 41 (FIGS. 8 and 10). This movement is controlled by guide cams 42, 43, for example in the form of rails, which further controls, via levers 44, 45, the inclination of the rods, as best seen in FIG. 9. Sheet elements 46, 47 are secured to the rods 38, 39 and, hence, incline or tip therewith. By lateral insertion of the sheet elements 46, 47 between the sides of the printed product elements, along the longitudinal fold edge 3, 4 upon movement in the direction of the arrows 40 and 41, the printed products are spread under control of the inclination of the separating sheets 46, 47, respectively. Upon bringing together the streams, as seen in FIG. 7, by bringing together the supply chains 34, 35 towards each other, the stack 22 will be formed. The stack, again, will be identical to that shown in FIG. 4.

FIGS. 11-20 illustrate a third embodiment of apparatus to carry out the invention by use of zig-zag carrier structures 48, 48'. The details of such carrier structures are known, see for example the referenced U.S. Pat. No. 4,840,365, and application U.S. Ser. No. 07/519,119, filed May 4, 1990 now U.S. Pat. No. 5,110,116, the disclosures of which are hereby incorporated by reference.

Figure 11:
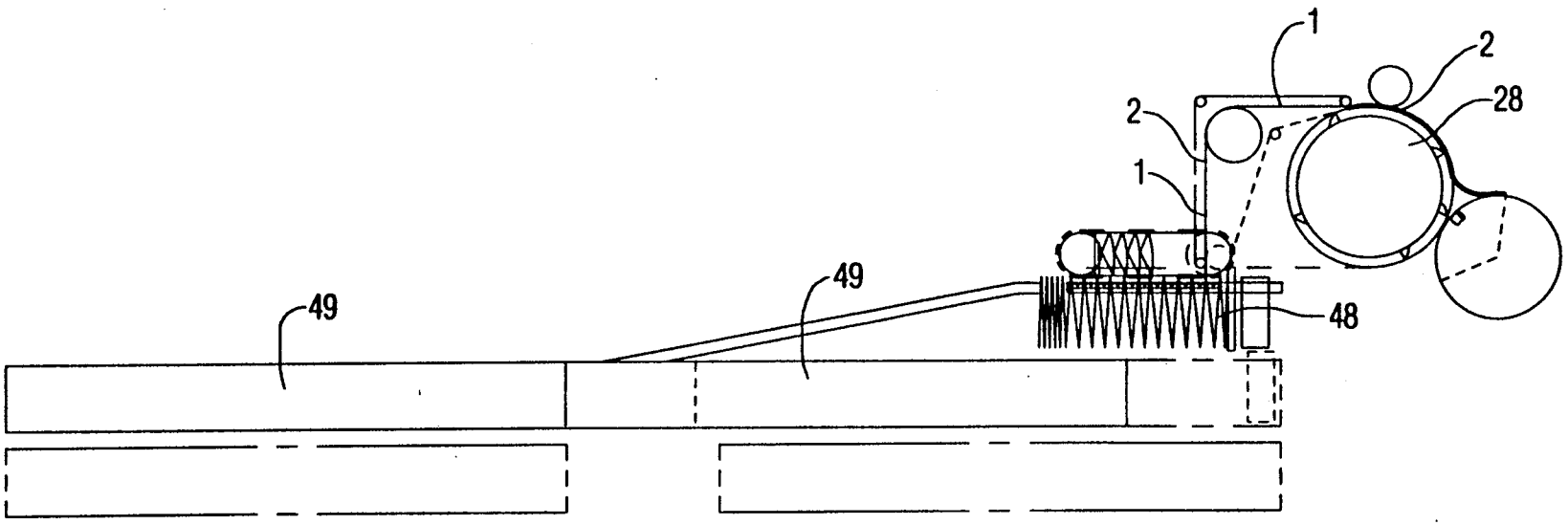
FIG. 11 illustrates, highly schematically, a third embodiment of a system to provide interdigited folded products.
Figure 12:
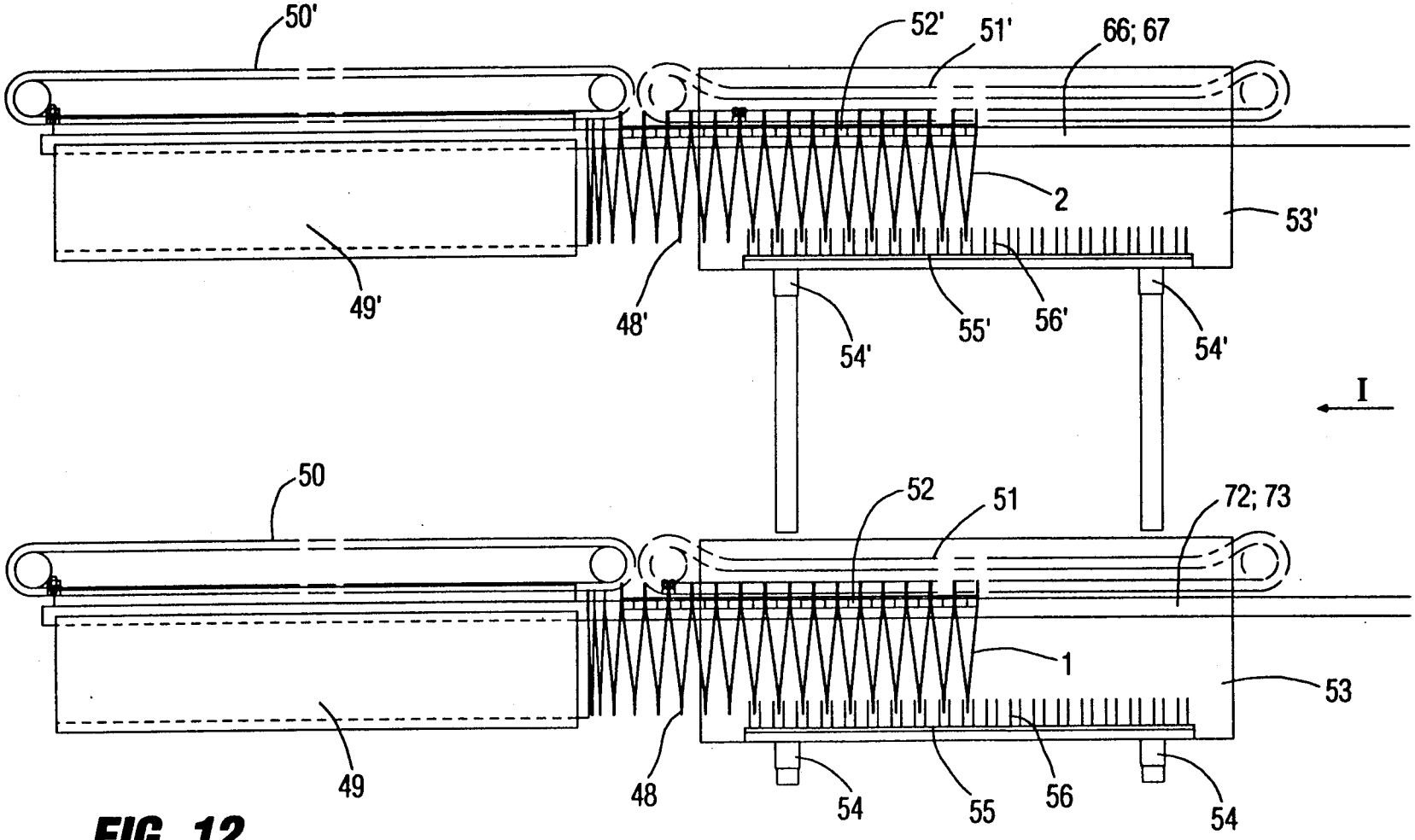
FIG. 12 is an enlarged fragmentary view of a portion of FIG. 11.

The referenced patent U.S. Pat. No. 4,807,865, the disclosure of which is hereby incorporated by reference, clearly shows how folded sheets 1, 2 can be removed from a folding flap cylinder 28 of the folding apparatus 29, and to insert them into the zig-zag structures 48, 48' (FIG. 12) as well as to store the filled zig-zag structures in storage cassettes 49 (FIG. 11). FIG. 12 also shows the positioning of the cassettes 49, 49' above each other. Drives, such as described in detail in the referenced U.S. Pat. No. 4,871,159, the disclosure of which is hereby incorporated by reference, and illustrated at 50, 51, and 50', 51', respectively in FIG. 12, permit removal of the zig-zag structures 48, 48' from the cassettes. The folded products 1 or 2, respectively, are opened at their center across the fold line by tongues 52, 52' as described in the referenced patents.

Figure 13:
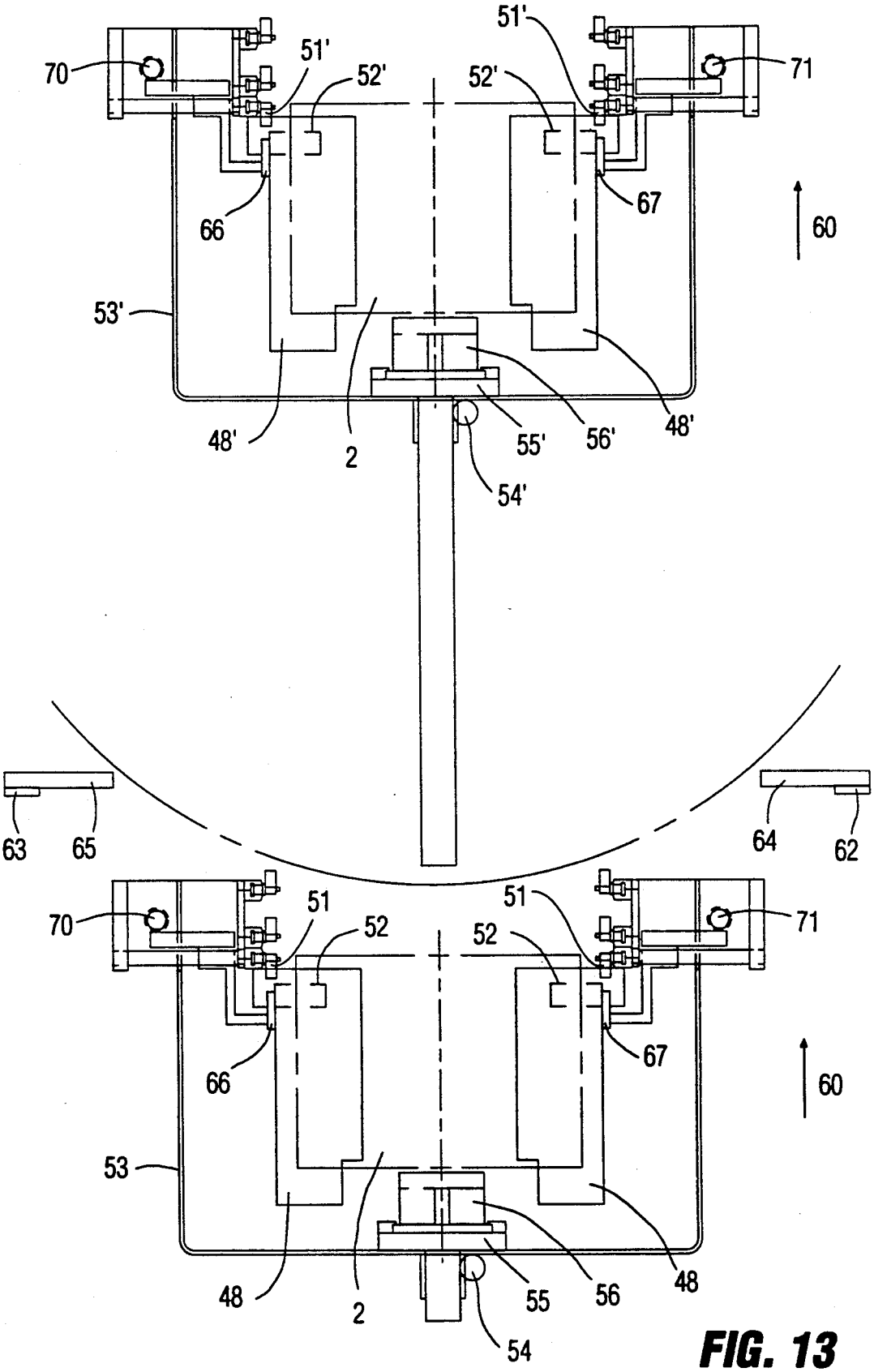
FIGS. 13 through 20 are schematic front and side views, respectively, of folded products stored in storage cassettes, in which FIGS. 13 to 20, schematically, illustrate different steps to effect the insertion of alternate folded products into each other.
Figure 14:
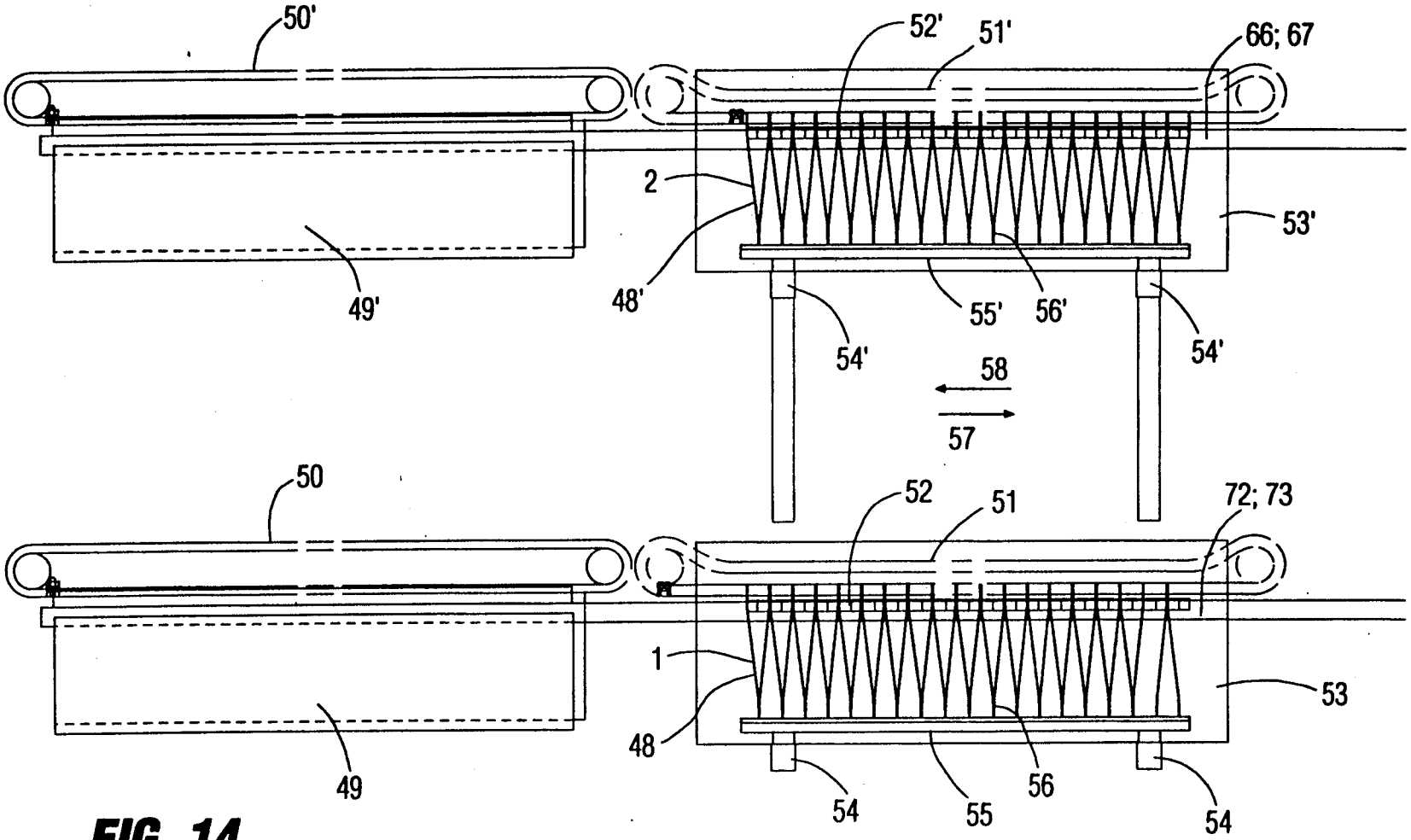
Figure 15:
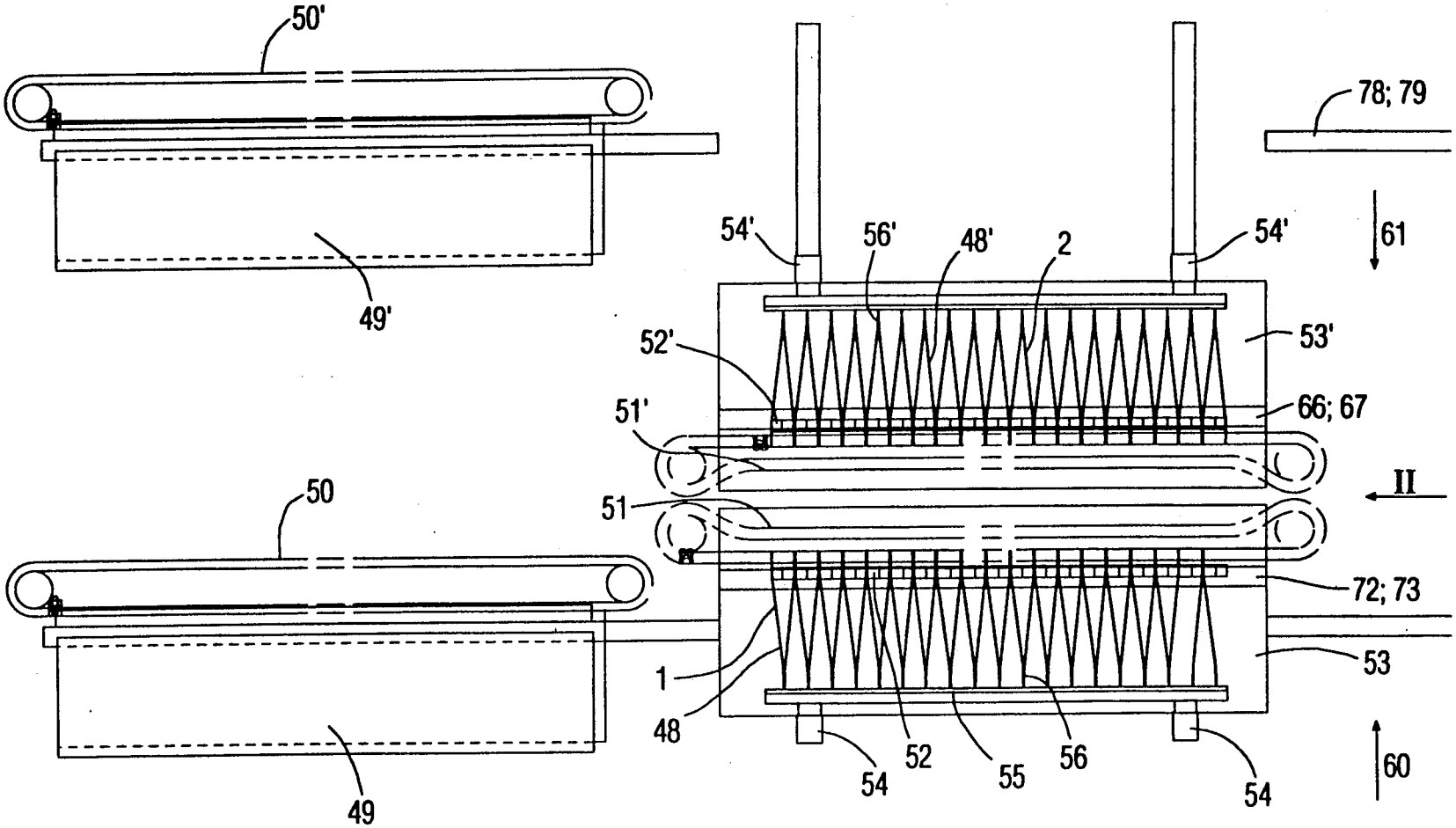
Figure 16:
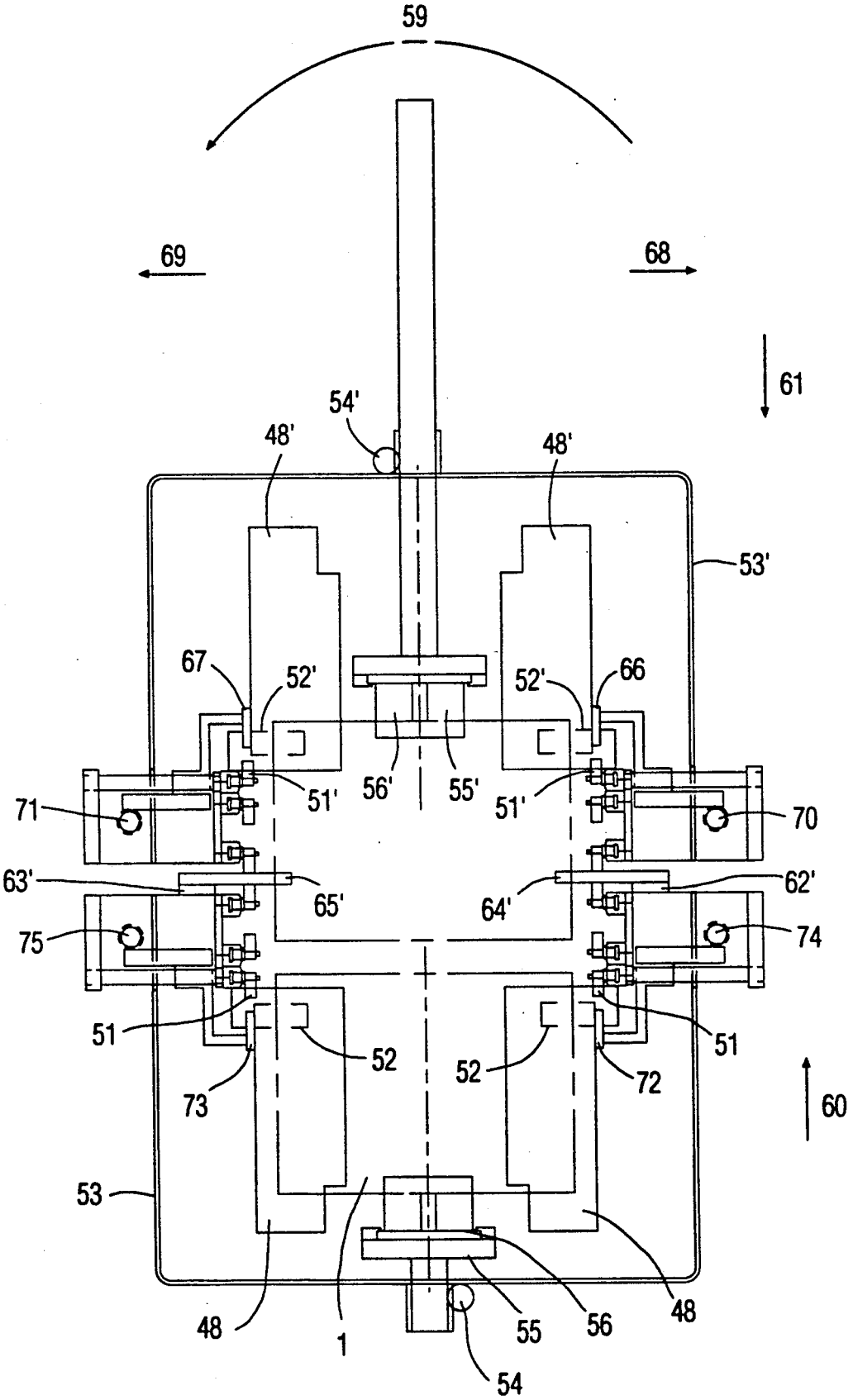
Figure 17:
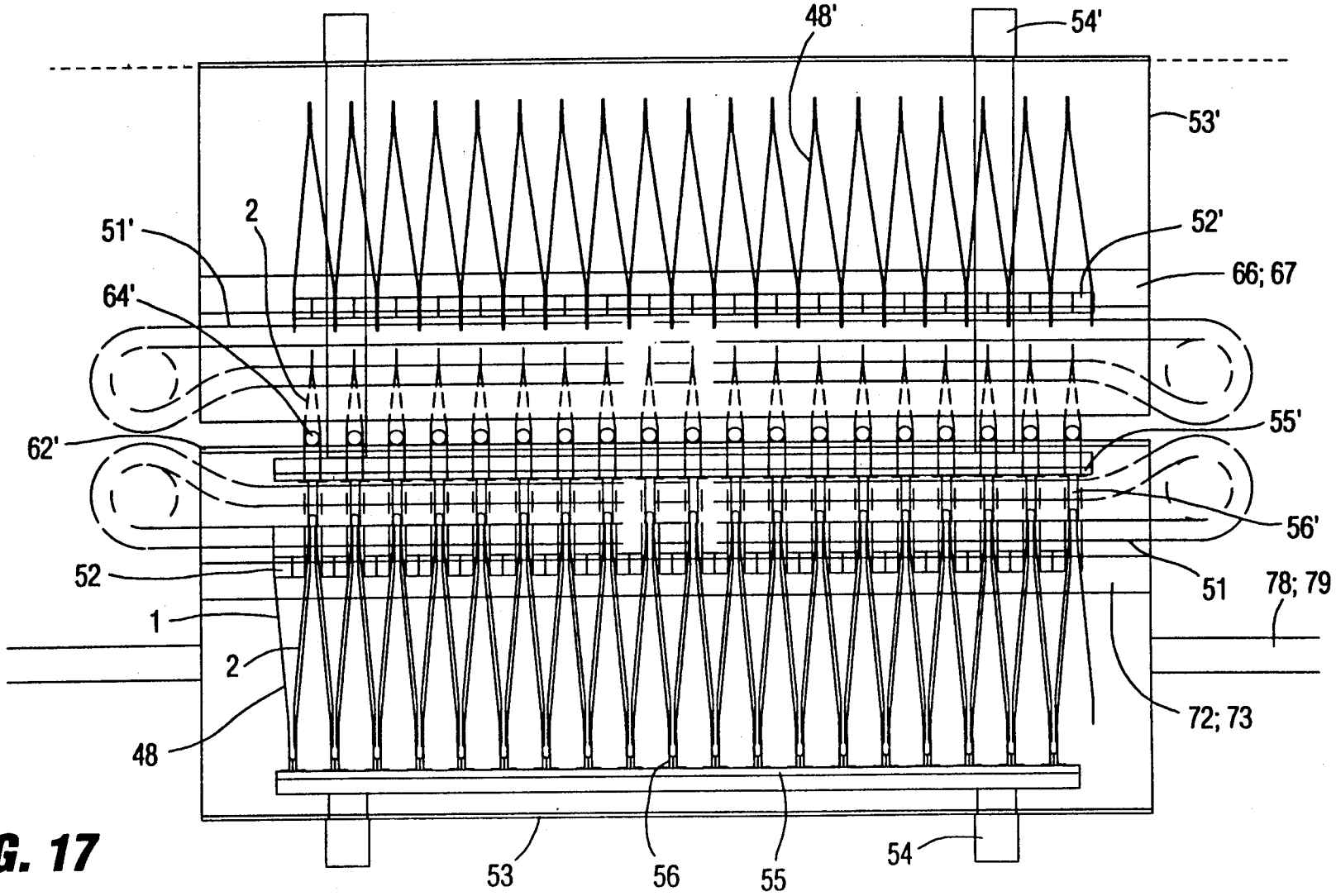
Figure 18:
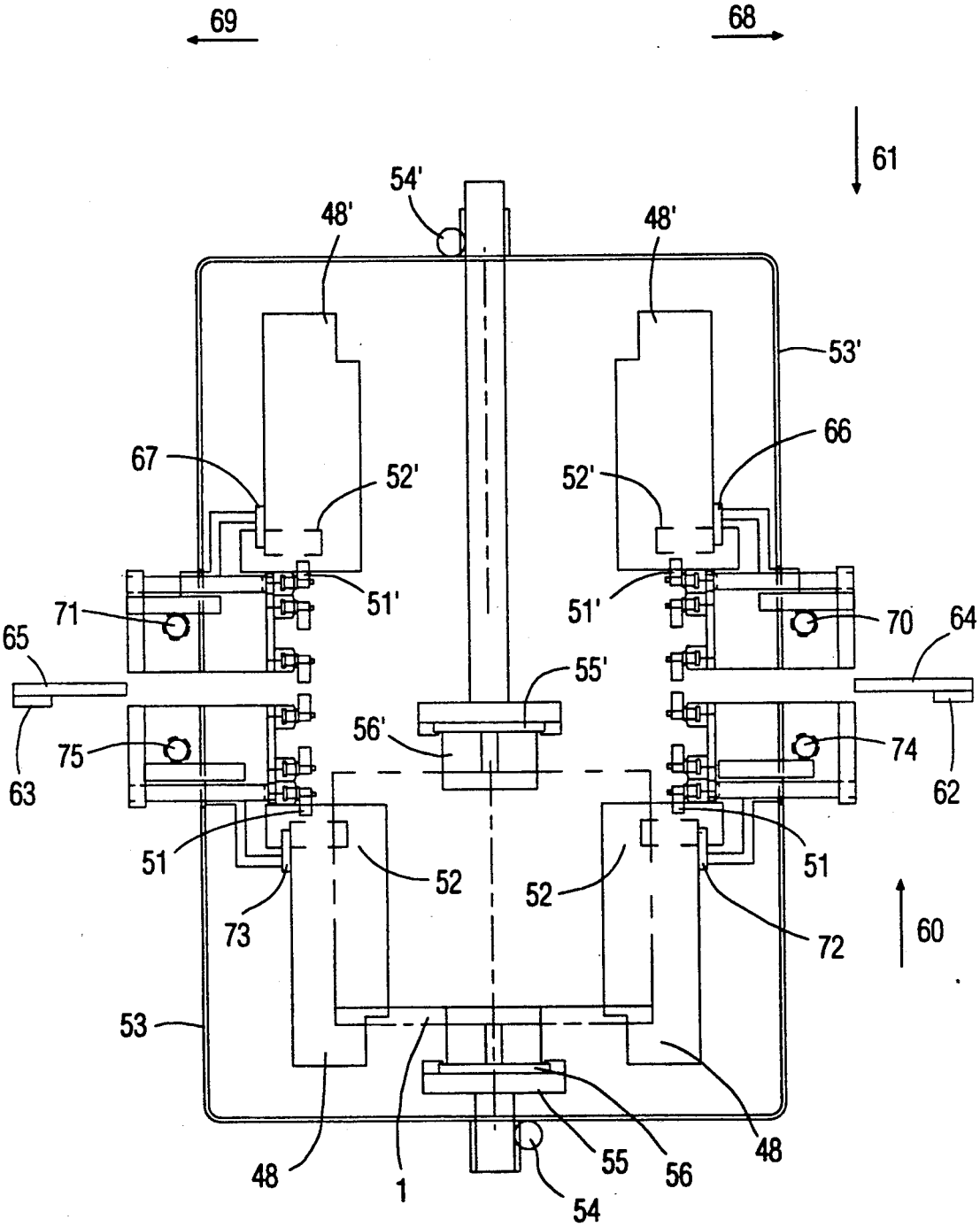
Figure 19:
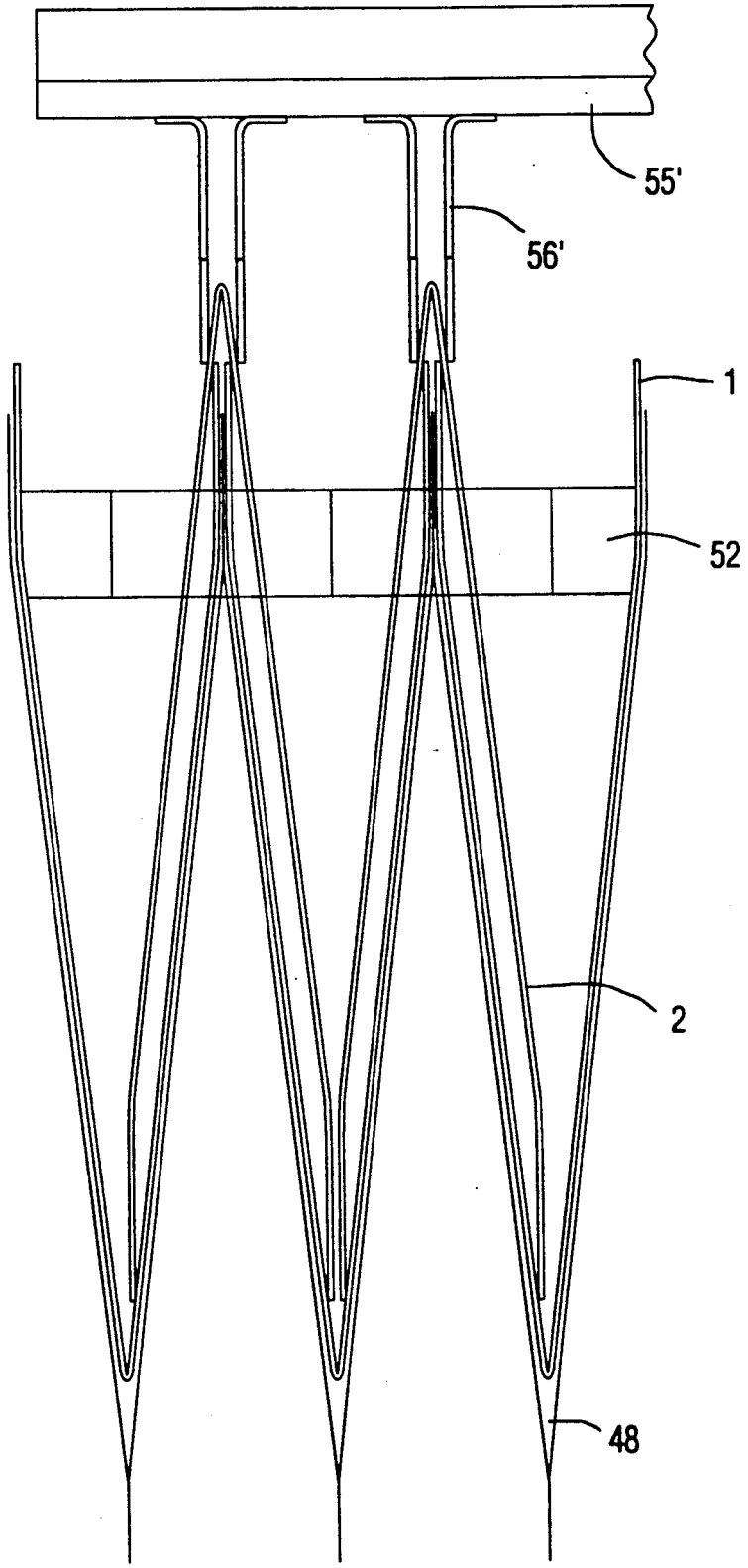

FIG. 13 is an end view of the apparatus of FIG. 12 in the direction of the arrow I. Drives 50, 51' are located in transportable or movable cassettes 53, 53'. The zig-zag structures 48, 48' with the folded products 1, 2 are completely removed from the cassettes 49, 49', as best seen in FIG. 14, and are entirely located in the cassettes 53, 53'. Drives 54, 54' (FIG. 14) lift clamping strips 55, 55' so that, by opposite movement of associated grippers 56, 56' in the direction of the arrows 57, 58, respectively, the respective printed products 2 are clamped at their lower edge or fold line. FIG. 15, and the end view thereof in the direction of the arrow II, FIG. 16, show rotation in the upper cassette 53' in the direction of the arrow 59 (FIG. 16) by 180° , so that the V-shaped opened printed products 2 are now head-to-head above the printed products 1 which, likewise, are in end-opened, V-form. Cassette 53 is now lifted somewhat in the direction of the arrow 60; the upper printed products 2 are dropped somewhat in the direction of the arrow 61 by the drive 54', until they have reached the position shown in FIG. 16. The spreader tongues 52' hold the printed products in open position. Upon further dropping, strips 62, 63 (FIG. 13) move into a forward position 62', 63' (FIG. 16) so that their fingers 64', 65', respectively, engage between the halves of the folded product. FIG. 17 is a side view of an intermediate position. In the position of FIG. 16, the zig-zag halves 48', with the tongues 52' thereon, are laterally moved away by lateral movement of the carrier rails 66, 67 in the direction of the arrows 68, 69, respectively, under control of drives 70, 71, to be removed from the region of the folded products 2. The folded products 2 then can be completely dropped under control of the drive 54'. The rails 62, 63, with their projecting ends 64, 65 can be withdrawn to their initial position. The elements 48, likewise, by lateral movement of the carrier rails 72, 73, respectively, in the direction of the arrows 68, 69, respectively, are placed in the position shown in FIG. 18, by means of drives 74, 75. The printed products 1, 2 are thus interdigited again as shown in FIG. 4, but form a horizontal stack. The complete dropping of the upper products 2 is best seen in FIG. 18, which is an end view of the lower cassette with the printed products in the position of FIG. 17. FIG. 19 is a fragmentary enlarged view illustrating the position of the printed products interdigited into each other.

In the next sequence of the operating cycle, grippers 56' or, respectively, the clamping strips 55, are released and can be reset to the starting position by the drive 54', and then the cassette 53' is again rotated by 180° to its initial position.

Figure 20:
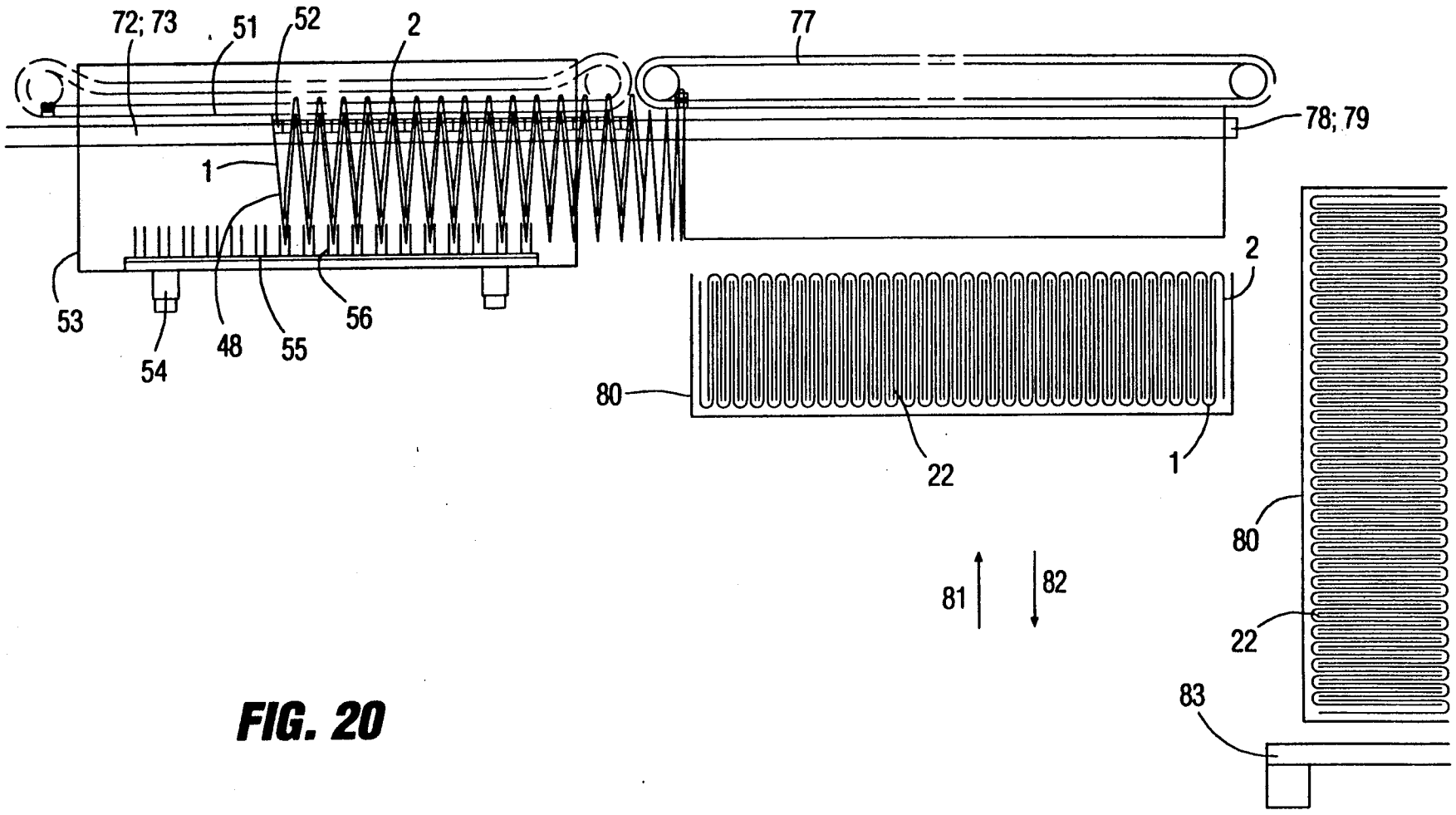

The holding structures 48, with the interdigited, interleaved printed products 1, 2, are then moved from the position shown in FIGS. 17 and 18 towards the right (FIG. 17) until they reach a drive, for example a chain drive as disclosed in the cross-referenced patents and schematically shown in FIG. 20 at 77, where they are pushed together or compressed. They then slide on rails 78, 79 to reach the region of a receptacle or cassette 80 which is moved upwardly to receive the folded, interdigited printed products in the form of a horizontal stack. Lateral movement of the carrier structures 48 in the direction of the arrows 68, 69 (FIGS. 16, 18) completely removes the structures 48 from the interdigited printed products. The stack 22, in the cassette 80, can now be tipped vertically by 90°, for example for placement on a pallette 83. Upon engaging, for example a fork lift, under the lowermost one of the interdigited printed products, the cassette 80 can be removed, for recycling for a subsequent reception of the stack. The stack 22 on the pallette 83 will be position-stable.

Various changes and modifications may be made, and any features described herein may be used with any of the others, within the scope of the inventive concept.

We claim:

1. Apparatus for stacking folded, essentially flat products (1, 2) received by the apparatus in identical orientation, said products having a back fold line (5, 6) and two sheet portions (1*a*, 1*b*; 2*a*, 2*b*) joined by a back fold at said back fold line, and, optionally, having a longitudinal fold line (3, 4) extending transversely to said back fold line, said apparatus comprising a product holder and engagement means (24, 25) having two parts, each part holding a respective first and second (1, 2) folded product;

separating means (26, 27; 46, 47; 64, 65) inserted into the folded products such that the sheet portions (1*a*, 1*b*; 2*a*, 2*b*) are held apart;

rotary means (23; 31, 42; 59) rotating the first product by 180° about an axis essentially perpendicular to the major plane of said first product; and means for moving said parts towards each other, after the rotary means have rotated said first product, for engaging said first and second products in a dual-comb like interdigited position within each other to permit forming a stack (22) of products of essentially uniform height, whereby the products in the stack will have facing orientation.

2. The apparatus of claim 1, wherein the rotary means, said product holder and engagement means, and said moving means comprise, conjointly, a gripping and transfer robot (23) having a pair of gripping arms (24, 25), each gripping a respective folded product (1, 2);

one of said gripping arms (24, 25) being rotatable by 180° about an axis essentially perpendicular to the major plane of said product, so that, after rotation of said one arm and the product thereon, said products can be assembled and interengaged within each other;

and wherein said separating means comprise separating sheet elements (26, 27) insertable between folds of the products (1, 2) for guiding the interdigited insertion of said products within each other.

3. The apparatus of claim 1, wherein said moving and said holder means conjointly comprise supply transport means (32, 33) individually supplying said second and first products while in identical orientation along respective separate paths;

said rotary means (31) include rotation apparatus (31) located in the separate path of the first product (1) for rotating the first product, about an axis essentially perpendicular to the major plane thereof by 180°;

and wherein said paths along which said transport means transport said products (1, 2) with the first product rotated 180°, are relatively positioned with respect to each other so that said products become interdigited in a double-comb like manner, in order to permit formation of said stack (22) of essentially uniform height.

4. The apparatus of claim 3, wherein said supply transport means include endless chain or belt means (34, 35) and guide means (36, 37) guiding said chain or belt means;

said separating means (46, 47) include separating elements inserted between adjacent sheet portions of said respective products (1, 2) and control means (38, 39; 42, 43) coupled to said inserted separating elements for controlling said separating elements to spread apart the adjacent sheet portions of the respective products;

and wherein said guide means are positioned relative to each other to guide the products (1, 2) spread apart by said separating elements, in paths which approach each other to place the products in interdigited form into each other.

5. The apparatus of claim 4, wherein said separating elements (46, 47) include sheet-like elements inserted between the sheet portions;

and further comprising cam elements (42, 43) controlling the respective inclination of said sheet-like elements with respect to the sheet portions of the products.

6. The apparatus of claim 3, wherein said supply transport means include a folding flap cylinder (28) and an alternately operating switch means (30) receiving the folded products from said folding flap cylinder (28) and guiding alternate products in said alternate paths, one of which includes said rotary means (31).

7. The apparatus of claim 1, wherein the product holder and engagement means (48, 48') comprises two carrier structures (48, 48') holding the products, respectively, in spread-apart form and oriented with respect to each other such that said first products are rotated about an axis essentially perpendicular to the major plane of the first products by 180° with respect to second products in the other carrier structure;

said carrier structures retaining said products such that the second (1) products are in V-shaped position, open towards the top, and the first products are in V-shaped position with the V being open towards the bottom and facing the open topes of the first product and defining for said first product an upside-down orientation with respect to the second product;

gripper means (56) are provided for gripping said upside-down first products (2) at the back fold (6), said gripper means, after removal of said first products from the respective carrier structure, lowering the spread-apart first products held thereon over said second products for interdigited, double-comb like placement with said second products.

8. The apparatus of claim 7, including lower product gripper means (56) retaining said second products at the respective back fold lines (5) thereof.

9. The apparatus of claim 7, wherein said separating means comprise lateral fingers (64, 64') laterally insertable between the sheet elements (2*a*, 2*b*) of said first products to retain the respective sheet elements in spread-apart position for interdigited placement with respect to the second products.

10. The apparatus of claim 7, further including guide track means (78, 79);

the holder means include a receptacle element (80) movable along said guide track means;

and means for transferring the interdigited first and second products (1, 2) into the receptacle element.

11. The apparatus of claim 10, wherein said receptacle element (80) is rotatable by 90° from an essentially horizontal to a vertical position.

12. The apparatus of claim 7, wherein said product holder and engagement means includes a cassette (53') and holder elements (48') retaining said first products in spread-apart zig-zag position, said gripper means (56') gripping said first products within the cassette (53');

and the rotary means rotating said cassette through 180° to turn over said first products (2) by rotating the first products about an axis essentially perpendicular to the major plane of the first products, whereby the back folds (6) of said first products will be placed in an upward position, and the open ends of the sheet elements will face downwardly; and wherein said cassette (53') retaining said first products is separable from said first products to permit said grippers (56') to place the first products in V-shaped roof-like position over said second products.

13. A method for stacking folded, essentially flat products (1, 2) received in identical orientation, said products having a back fold line (5, 6) and two sheet portions (1*a*, 1*b* ; 2*a*, 2*b* ) joined at said back fold line, and, optionally, having a longitudinal fold line (3, 4) extending transversely to said back fold line, comprising the steps of mechanically separating the sheet portions from each other, whereby said folded products will assume open V-shaped positions and have spread-apart ends of respective sheet portions;

retaining first and second open folded products (1, 2) respectively in two groups in respective holder means (24, 25);

rotating the products of only a first one of said groups 180° with respect to the products of the other of said groups about an axis essentially perpendicular to the major plane of the products;

moving the products of said first group and said second group towards each other and interdigiting the sheet portions (1*a*, 1*b*; 2*a*, 2*b*) into each other to place said folded products into dual-comb like interdigited position within each other;

stacking said interdigited products in an essentially vertical stack which is of essentially uniform height, whereby the products in the stack will be in facing orientation.

14. The method of claim 13, wherein said moving and interdigiting step comprises guiding a plurality of said first products (1) in a curved path, with the open ends of said sheet portions facing in a first direction;

guiding the second products (2) in a curved path with the open ends of the sheet portions facing the open ends of said first products;

and then guiding said products in converging paths to interdigit the open ends of the first and second products into each other whereby said products will be interdigited with one product (1) oriented 180° with respect to the other.

15. The method of claim 13, wherein said moving and interdigiting step comprises aligning said second products with the open ends of sheet portions facing upwardly in spread-apart V formation;

rotating and aligning the first products with the open ends of the sheet portions facing downwardly and above said second products; and moving said first and second products towards each other, while they are retained in spread-apart open V-shaped position.

16. The method of claim 13, wherein said steps of separating the sheet portions of the folded products, retaining the separated and thus open products in two groups, and rotating the products of one of said groups, are performed in a single combined operating sequence.

* * * * *